United States Patent [19]

Archer et al.

[11] 4,230,540

[45] Oct. 28, 1980

[54] TECHNIQUE FOR AUTOMATIC QUENCHING OF ANODE EFFECTS IN ALUMINIUM REDUCTION CELLS

[75] Inventors: Anthony M. Archer; Edward L. Cambridge; Douglas F. Hewgill, all of Kitimat, Canada

[73] Assignee: Alcan Research and Development Limited, Montreal, Canada

[21] Appl. No.: 33,213

[22] Filed: Apr. 25, 1979

[30] Foreign Application Priority Data

Apr. 27, 1978 [GB] United Kingdom ..... 16809/78

[51] Int. Cl.[3] ..... C25C 3/06; C25C 7/06

[52] U.S. Cl. ..... 204/67

[58] Field of Search ..... 204/67, 225

[56] References Cited

U.S. PATENT DOCUMENTS

| | | | |
|---|---|---|---|
| 3,888,747 | 6/1975 | Murphy | 204/67 |
| 4,024,034 | 5/1977 | Doring et al. | 204/67 |

*Primary Examiner*—Howard S. Williams

*Attorney, Agent, or Firm*—Cooper, Dunham, Clark, Griffin & Moran

[57] ABSTRACT

For the clearance of anode effects in operation of electrolytic cells for aluminium production, movement in the metal pool is induced to effect short-circuiting of the cell and disturbance of any gas film on the face of the anode(s) by raising the anode(s) and then lowering them to datum position and/or tilting the anode in relation to datum position. Upward movement is terminated either after a predetermined distance or when a predetermined cell voltage is attained. Fresh alumina is introduced into the cell by breaking alumina crust by anode movement or by independent supply.

10 Claims, 4 Drawing Figures

TECHNIQUE FOR AUTOMATIC QUENCHING OF ANODE EFFECTS IN ALUMINIUM REDUCTION CELLS

BACKGROUND OF THE INVENTION

The present invention relates to a method of operating electrolytic reduction cells for the production of aluminum.

In the Hall-Heroult process aluminum is produced by the passage of electric current through a molten electrolyte consisting of cryolite ($Na_3AlF_6$) with normally an excess of $AlF_3$ and small quantities of other alkali metal and alkaline earth metal fluorides such as LiF, $CaF_2$ and $MgF_2$ and containing dissolved alumina in an amount of about 2–8%. The cell is lined with carbon blocks which form the cathode and one or more carbon anodes are suspended above the cell and dip into the electrolyte.

The anodes may be of the pre-baked block type or the Söderberg type, in which a viscous carbonaceous mix is fed into a casing and is baked in situ.

In normal operation current passing between the anode and cathode decomposes alumina to form aluminium, which collects at the cathode, and oxygen, which is released at the anode and combines with the carbon anode to form gaseous oxides, which are freely ejected from under the anode face, because the carbon oxides do not wet the anode material.

In operating the electrolytic reduction cell the molten electrolyte is covered with a crust of solid material, onto which fresh alumina is supplied. Fresh alumina is supplied to the cell by breaking the crust and it is therefore not always possible to correctly gauge the amount of alumina that enters the electrolyte at each crust-breaking operation. In consequence occasionally the concentration of alumina in the cell electrolyte falls to a novel (0.5–2.2% alumina) where the fluoride salts start to decompose with consequent formation of gaseous fluorine compounds. These consist primarily of carbon tetrafluoride, which, unlike the carbon oxides, wet the anode material to form a stubborn, high-resistance film on the anode face and severely reduce the contact area between the face of the carbon anode and electrolyte. Under this condition, the overall cell voltage typically rises from 5 to 40 volts.

This phenomenon is normally referred to as "an anode effect". It is well known that corrective action must be taken quickly to counteract the deleterious results of the "anode effect" and regain normal operation of the cell. It is conventional to commence corrective action as soon as the cell voltage rises above 10 volts. In addition to restoring the alumina content to a normal operating level of 2–8%, positive action is required to remove the high resistance gas film at the anode face so as to reduce electrical resistance at the anode/electrolyte interface and to restore the current density at the interface to the normal operating level in the region of 0.55–1.10 amps/cm$^2$.

In conventional practice when an anode effect is detected as a result of a sudden large rise in the cell operating voltage, the alumina concentration of the bath is restored by breaking the crust, and this is immediately followed by action to remove the layer of gaseous fluoride on the bottom face(s) of the anode(s) and to reduce the current density on the major portion thereof. For example, it is known to remove the gaseous film by scraping the anode face with a steel rake, by rapid injection of air into the inter-electrode space or by the insertion of a wooden pole under the anode. The last method depends on the rapid decomposition of the wood in contact with the bath electrolyte (circa 1000° C.) with consequent release of large quantities of gas to flush the anode face. At the same time sufficient local disturbance in the metal pool is created to cause short circuiting of the metal to the anode face. This reduces the current density on the remainder of the anode face. Once the current density falls below a given critical value, the process is restarted.

The conventional methods of clearing "anode effects" are labour intensive and have other disadvantages. A significant quantity of materials, such as steel rakes or wooden poles is consumed with consequent introduction of impurities into the cell, and reoxidation of metal. Moreover these methods are virtually incapable of being performed under automatic control in response to rise in cell voltage.

Various methods of clearing anode effects, involving physical vertical movement of the anodes, have been devised. All electrolytic reduction cells are equipped with jacks for vertical movement of the anodes which are required to maintain the anode-cathode distance as nearly as possible at a target value, chosen to provide optimum cell operation. The consumption of anode material and the increase in the depth of the metal pool (the surface of which is the effective cathode surface) require periodic change in the anode face position to re-adjust the anode-cathode distance to the target value. Thus the cells are equipped with power-driven means for anode movement.

Existing methods of clearing anode effects by vertical movement of the anode involve some crust breaking action and increase of the alumina content of the bath. These methods have involved lowering the anode to bring the anode face into contact with the metal pool. The contact between the anode and the metal pool has the effect of displacing the fluoride gas film and at the same time short circuits the bath, thus reducing the current density on the remaining major portion of the anode face, which is out of contact with the molten metal. It is known that when the alumina content of the bath has been restored to a correct level and the process has been restarted by creating a local displacement of the fluoride gas film on the anode face and a local short circuit of the bath, the generated carbon oxides will flush away the remainder of the fluoride gas on the anode surface. This restores the cell to its normal operating condition.

Clearance of anode effects by anode lowering has been reasonably successful with electrolytic reduction cells of both the prebake-anode and horizontal-stud Söderberg type. In addition to reduction of current density on large areas of anode face, the method relies on replenishing and mixing alumina in the electrolyte bath through the tidal movement of the electrolyte in the peripheral region between the anode(s) and the cell wall resulting from the displacement of electrolyte as the anode(s) are first lowered and then raised.

That method of clearing anode effects can be initiated automatically in response to increase in cell voltage. Because of the high ratio of anode face area to bath surface area in the annulus between anode and cell side wall in a vertical stud Söderberg type cell, upward displacement of bath resulting from the lowering of the anode to make a short circuit would result in unacceptably large and frequent spillage of molten electrolyte.

Furthermore the resulting movement of the electrolyte can lead to blockage of the gas collection skirt on the anode by frozen electrolyte.

SUMMARY OF THE INVENTION

These considerations have led to the procedure of the present invention for clearing anode effects in electrolytic reduction cells. The procedure of the invention, although devised to overcome a difficulty experienced with vertical stud Söderberg cells, is equally applicable to any electrolytic cells for operating the Hall-Heroult process irrespective of the type of anode with which the cell is equipped.

By contrast with earlier practice involving vertical movement of the anode(s), in the procedure of the present invention the anode or anodes of the cell are cyclically raised from their datum position and lowered again to the datum position.

According to the present invention a method of clearing anode effects in the operation of an electrolytic reduction cell for the production by electrolysis of alumina in a molten fluoride bath comprises raising the anode or anodes of the cell from a datum position by a predetermined distance or until a predetermined high cell voltage is established and lowering the said anode or anodes, alternatively or additionally tilting the lower end face of said anode or anodes, such raising and lowering and/or tilting being performed in such manner that short circuiting between the anode(s) and the pool of molten aluminium in the cell takes place during such anode movement as the result of local upward movement of said molten metal due to electromagnetic effects, fresh alumina being added to said molten fluoride bath in conjunction with movement of said anode(s) of said cell. Addition of alumina may be achieved by breaking the alumina crust of the cell anode movement or by independent external supply.

It is surprising that it is possible to effect short circuiting between the anode abd the metal pool in this manner. However, cyclical upward and return movement of the anode to datum position creates crust distribution distortions in the cell, resulting in electromagnetically induced movement in the metal pool, in addition to breaking and washing the crust to replenish the alumina in the bath.

In the method of the invention the anode movement is performed in such a way that the resultant movement of the electrolyte and metal has the effect of causing a short circuit of the bath by reason of movement of metal in the pool beneath the bath. Contact between the molten metal and the anode is often reflected in a momentary drop of the cell voltage. Similarly as a result of the violent agitation taking place at the anode/bath interface while the anode is in the raised position, the gaseous fluoride is displaced in a successful operation for clearance of the anode effect.

For cells in which the current distribution is uniform or nearly so, such that little movement of the metal pool results from a straight lift of the anode, distortion of the current distribution and movement of the metal pool can be achieved by vertically moving the two ends of the anode support beam of a Söderberg anode by unequal amounts or in opposite directions so as to tilt the lower face of the anode. Where the anode effect is cleared by tilting the anode(s) without lowering the anode mass the tilting movement may be such as to lower the bottom edge of the anode into direct contact with the metal pool. Alternatively, sufficient current disturbance may be created by lesser tilting movement to effect contact with the anode through local upward movement of the surface of the molten metal.

The downward movement of the anode(s) results in further movement of the electrolyte to dissolve and distribute the fresh alumina introduced into the cell by the crust-breaking due to movement of the anode(s) and/or introduced by a separate alumina feeding device. To promote this movement of the electrolyte, the lowering of the anode(s) is preferably effected in steps, while the raising of the anode(s) is preferably effected in a signal step.

In the procedure of the present invention the or each anode is raised from its datum position preferably by a distance of 1–5 cms, more preferably 1.5–3.0 cms. Alternatively, the anode raise may be controlled in response to change in the cell voltage; being continued until the cell voltage increases to a predetermined high value, such as 70 volts, which can only be reached by a substantial upward movement of the anode. The anode raise is then halted, the anode preferably held in that position for the normal pause time mentioned below, and then lowered to its datum position by stepwise decrease in vertical distance above its datum position. The cycle is then continued in the normal fashion.

Although various operating sequences in accordance with the invention can be devised, in one series of tests the sequence selected involved raising the anode through about 3.0 cms in 30 seconds and lowering the anode through the same distance in steps in about 28 seconds of movement (because the lowering could be performed at slightly greater rate than raising).

In this sequence in each cycle the anode was raised for 30 seconds at a velocity of 0.1 cms/sec., held in the raised position for 30 seconds, lowered during 16 seconds, held for 4 seconds and then lowered to its start position in three steps of 4 seconds with a pause of 4 seconds between each of the lowering stages.

The cycle of raising and lowering was repeated three times with an interval of 15 seconds between cycles, and followed by another short 1 cm. raise immediately followed by a similar lowering to the datum position. This cycle of operations resulted in a success rate of about 90% in quenching anode effects.

The rest intervals at the top of the raise, during the stepped descent and between successive cycles may be varied quite widely, conveniently in the range of 5–60 seconds. However it is preferred to keep the rests as short as possible, consistent with effective clearance of anode effects, so as to restore the cell to normal operation as quickly as possible.

DETAILED DESCRIPTION OF THE INVENTION

Figure 1:
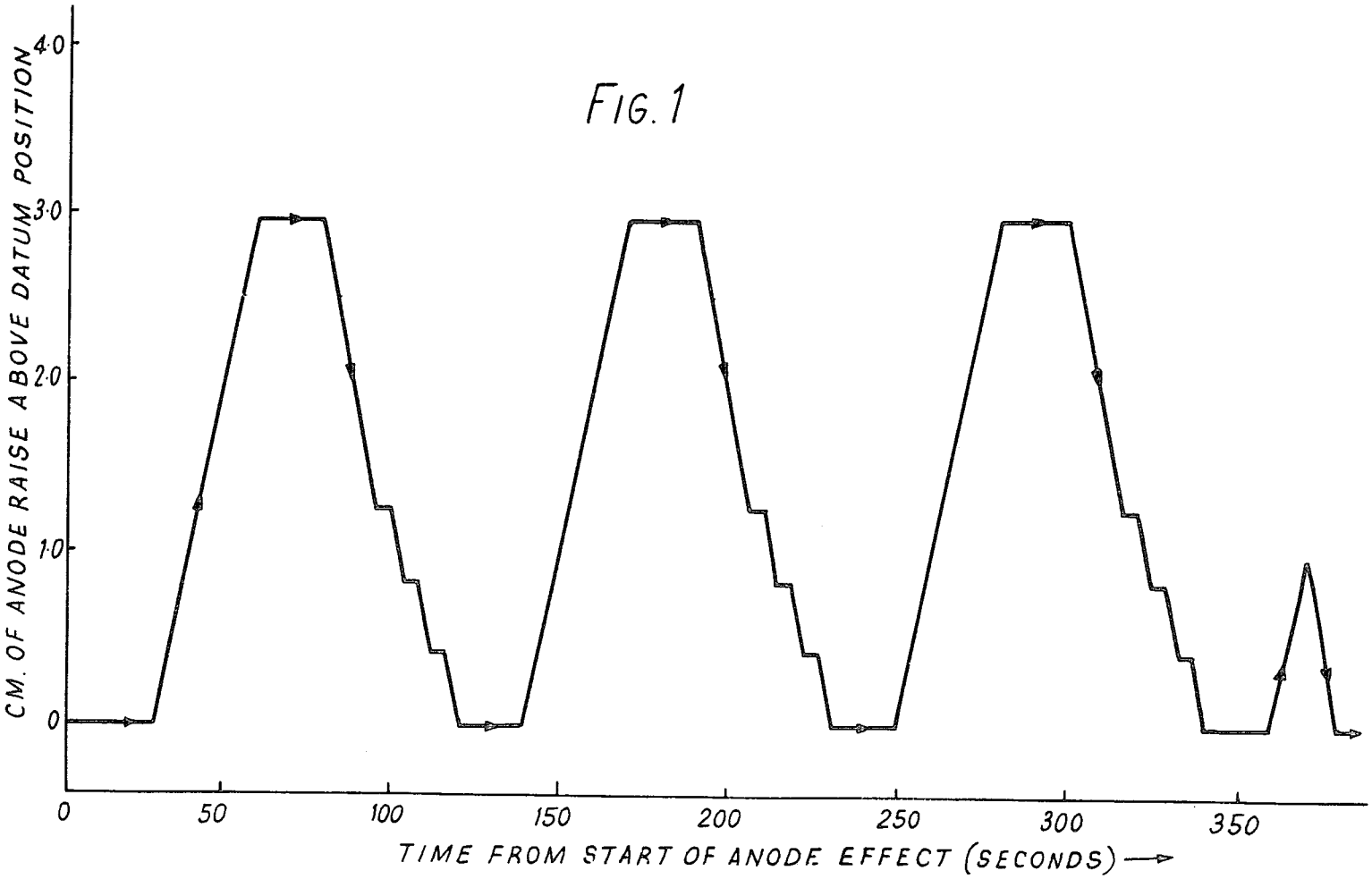
FIG. 1 illustrates a cycle of movement of an anode for quenching an anode effect in accordance with the invention in which the anode is raised by a predetermined distance.

In another test carried out over a prolonged period eight 125 KA vertical stud Söderberg cells utilised the anode effect-quenching cycle illustrated in FIG. 1.

In this it will be seen that the straight rise/stepped descent movement was repeated three times in the cycle, followed by another short 1 cm. raise immediately followed by a similar lowering to the datum position. Since at the end of the anode effect-quenching cycle of movements the anode is returned to its datum position, it is most convenient for the purpose of operating under automatic control that the pattern of the repeated movements should be identical, so that at the end of each of the stepped descent movements the anode is returned to its datum position. However it is by no means essential to the success of the operation to return the anode exactly to its datum position at the end of any of the three stepped descents. The anode should be returned to datum at the end of the final short up/down movement. At any interval of say 200 seconds after the completion of the final movement a check of the cell voltage is made over a period of 10 minutes and provided the voltage does not exceed 10 V over this time, the anode quenching operation is deemed successful. In the small proportion of failures, anode effects must be cured by one of the more drastic manual techniques already referred to.

Figure 2:
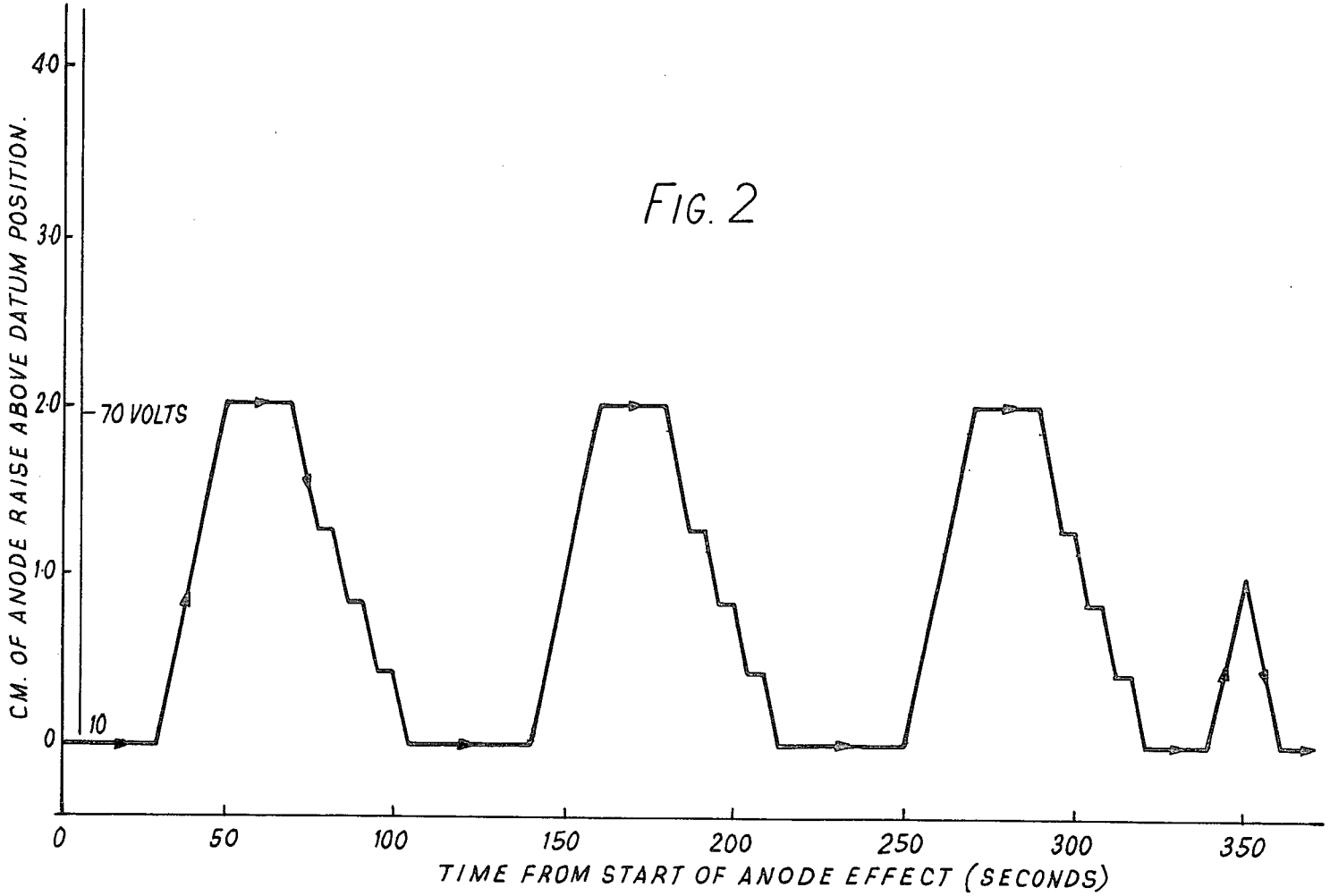
FIG. 2 illustrates an alternative cycle of movement in which the anode raise is halted in accordance with a predetermined increase in cell voltage.

An alternative sequence of anode movements for quenching anode effects is shown in FIG. 2. In this case the upward movements of the anode is stopped when the cell voltage rises to a predetermined limit (usually 70 volts). The height at which such a cell voltage will be reached is unpredictable. Such height could be different in each of the three cycles.

In both cycles it is convenient to associate a revolution counter with the anode-raising screw jacks, so that the drive motors are cut out when the jack screws have returned to their start position. The electrical control system of the jack motor(s) is arranged to restart the descent after a predetermined rest and to cut out the drive after a predetermined number of revolutions to provide the steps in the descent.

The cycle of movements illustrated in FIGS. 1 and 2 has been found satisfactory in the typical vertical stud Söderberg cells to which they were applied and it is believed that in most instances the essential short circuiting of the cell will be achieved by movement of the metal pool resulting from the anode being raised. However in adapting the procedure of the present invention to a particular cell design the anode raising velocity and anode altitude must be adjusted to values such that short circuiting between the anode and the metal pool will occur. This occurrence may be checked by observation of the cell operating voltage during anode effects. As already indicated, the distortion of current distribution to establish the movement of the metal pool, may require that the lower face of the anode is tilted. Preferably this may be achieved by arranging that the jack motor for one end of the anode beam starts somewhat before the jack motor for the other end of the beam. Alternatively the two jack motors may be arranged to turn at slightly different speeds so that the anode tilt increases as the anode is raised, or that the jacks move in opposite directions.

Figure 3:
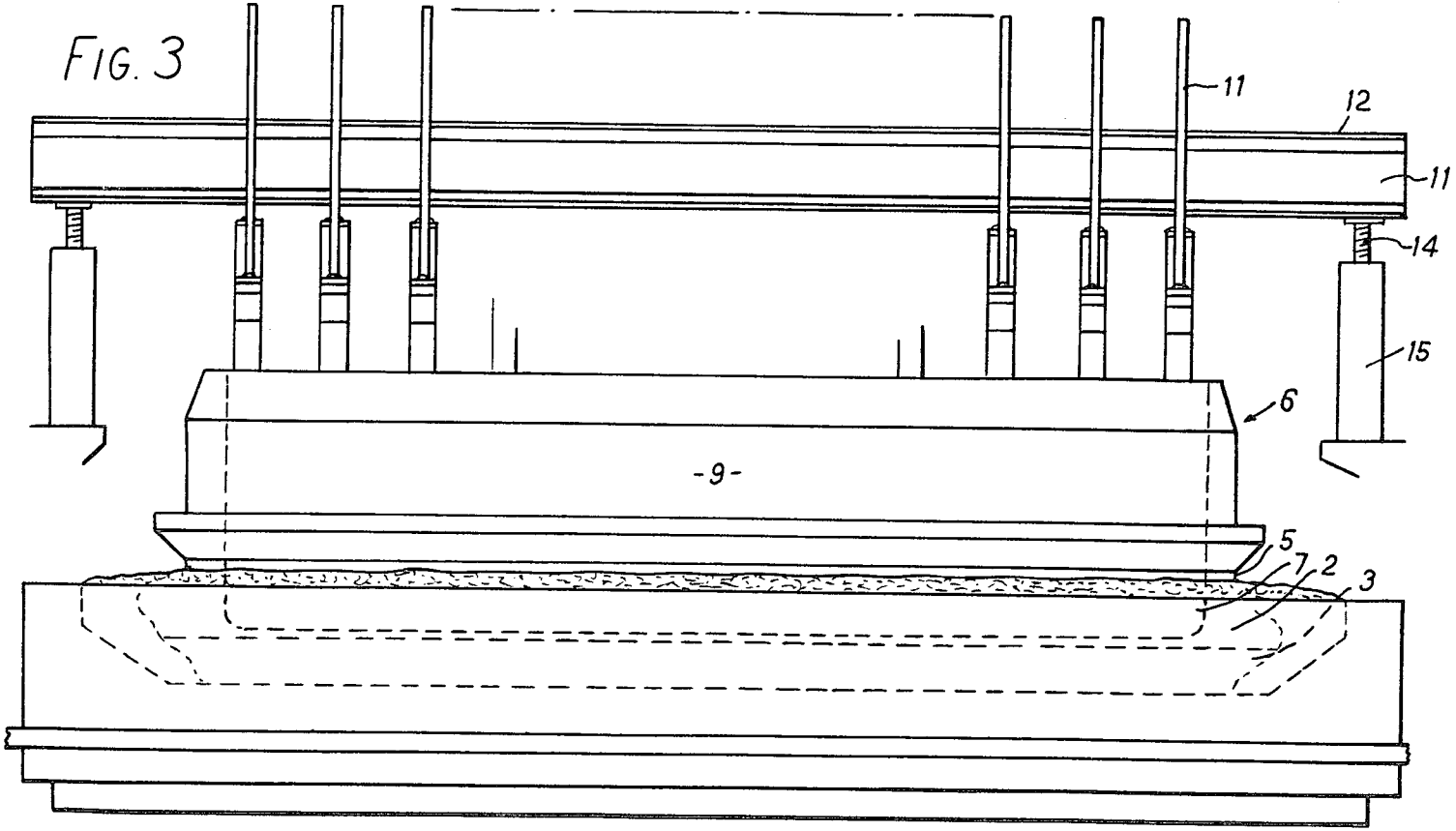
FIG. 3 is a diagrammatic side view of a reduction cell equipped with a vertical stud Söderberg anode, and, FIG. 4 is a diagrammatic cross-section of the cell of FIG. 3.
Figure 4:
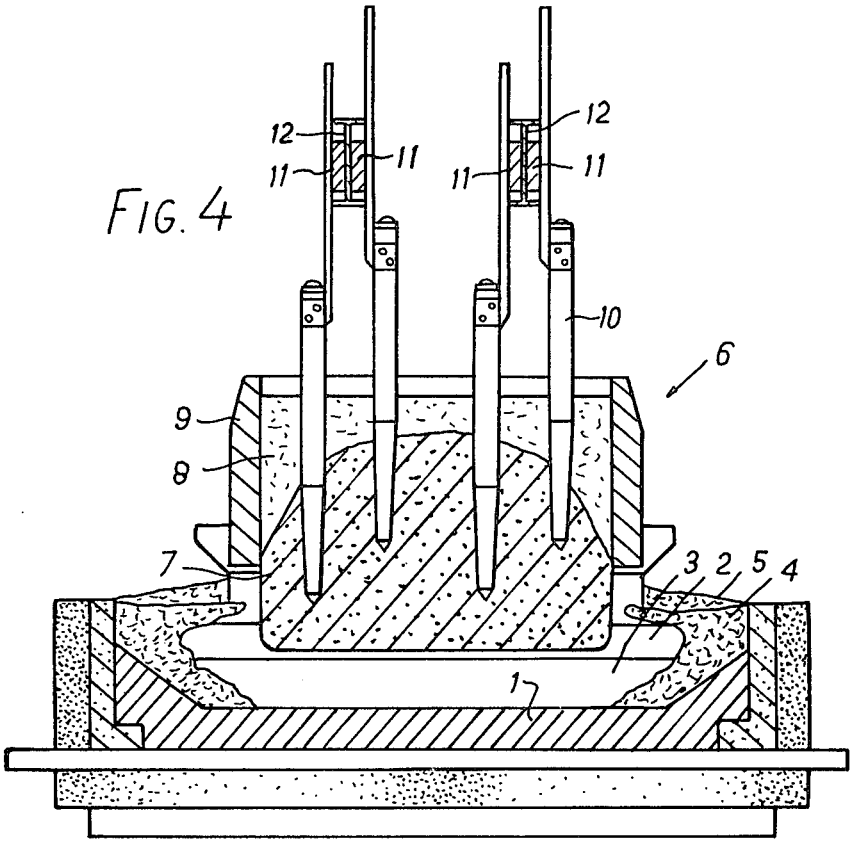

Referring to FIGS. 3 and 4, a conventional cell, having cathode lining 1 for holding a body 2 of fused alumina-containing fluoride electrolyte, overlying a pool 3 of molten product aluminum, a peripheral mass 4 of frozen electrolyte and a crust 5 of alumina, is equipped with a conventional vertical Söderberg electrode 6, which will be seen to occupy a large part of the superficial area of the body of fused electrolyte. In consequence upward or downward movement of the electrode 6 is reflected by a change of level of the electrolyte which is usually greater than the movement of the electrode. Moreover downward movement of the electrode from the datum position to bring it into direct contact with the metal pool 3 can set up unpredictable tidal movements in the electrolyte, possibly leading to overflow from the cell.

In the illustrated conventional construction the Söderberg anode comprises a carbon mass 7 and a mass 8 of viscous anode paste within a casing 9. The carbon mass 7 is suspended by anode studs 10, clamped to bus bars 11. The bus bars 11 are secured to a pair of anode beams 12, which are respectively provided with screw jacks 14 at each end. Each screw jack is driven by an electric motor 15.

It will readily be seen that the whole anode mass can be raised and lowered by operating all motors in synchronism and this may have little effect on the current distribution on the bottom face of the carbon anode 7. If, however, the motors 15 are run slightly out of synchronism with each other the lower face of the anode mass may be slightly tilted laterally and/or longitudinally with resultant disturbance of the current distribution and consequent large electromagnetic unsymmetrical forces acting on the molten metal of the pool 3, leading to movement in such pool and causing the upper surface of the pool to assume local convexity sufficient to lead to short circuiting between the cathodic metal pool and the face of the anode. A similar and more severe effect is achieved when the anode face is only partially in contact with the molten electrolyte at the top of the cycle.

On the other hand where the cell is equipped with a series of separate prebake anodes, simple vertical upward movement of the anodes will lead to sufficient change in the current distribution to cause adequate movement in the metal pool through the change in the electromagnetic forces to lead to short circuiting.

The actuation of the cell motors so that the anode follows a cycle of movements as shown in FIGS. 1 and 2 can readily be performed under the control of the cell operator. Alternatively the actuation of the motors can be performed under the control of a pre-programmed electronic processor, which automatically responds to the initial increase in cell voltage due to the anode effect.

While the present method of quenching anode effects has been devised primarily for vertical stud Söderberg cells, it is nevertheless advantageous for cells equipped with prebake anodes or horizontal stud Söderberg cells.

Even with these cells anode-effect quenching by lowering the anode(s) too far or too quickly can lead to electrolyte spillage. Excessive anode lowering can, particularly in the case of prebake anodes, result in contact by the bath with auxiliary steel fitments, resulting in iron-contamination of the bath and damage to the steel fitments by virtue of attack by the bath electrolyte.

We claim:

1. A method of clearing anode effects in the operation of an electrolytic reduction cell for the production of aluminium by the electrolysis of alumina in a molten fluoride bath which comprises raising the anode or anodes from a datum position by a predetermined distance or until a predetermined high cell voltage is established and lowering the said anode or anodes, such raising and lowering being performed in such manner that short circuiting between said anode or anodes and the pool of molten aluminium in the bottom of the cell takes place during such anode movement as the result of local upward movement of said molten metal due to electromagnetic effects, fresh alumina being added to said molten fluoride bath in conjunction with movement of said anode or anodes of said cell.

2. A method according to claim 1 in which said anode is lowered in a series of steps.

3. A method according to claim 1, in which the raising and lowering of the anode is repeated one or more times at short intervals.

4. A method according to claim 1 in which the anode or anodes are raised by 1–5 cms from the datum position.

5. A method according to claim 1 in which the anode or anodes are raised by 1.5–3.0 cms from the datum position.

6. A method according to claim 1 in which there is an interval of 5–60 seconds between completion of raising the anode and commencement of lowering the anode.

7. A method according to claim 3 in which said short intervals are in the range of 5–60 seconds.

8. A method as claimed in claim 1, in which the lower end face of said anode or anodes is in a tilted attitude during the course of the vertical movement of the anode or anodes.

9. A method of clearing anode effects in the operation of an electrolytic reduction cell for the production of aluminium by the electrolysis of alumina in a molten fluoride bath which comprises tilting the anode or anodes from a datum position, without lowering the mass of said anode or anodes, in such manner that short circuiting between the anode or anodes and the pool of molten aluminium in the bottom of the cell takes place, the anode or anodes then being returned to said datum position, fresh alumina being added to said molten fluoride bath in conjunction with the movement of said anode or anodes of said cell.

10. A method according to claim 9 in which the tilting of said anode or anodes is effected in such manner that the short circuiting between the anode or anodes and the pool of molten metal is the result of local upward movement of said metal due to electromagnetic effects resulting from distortion of current distribution at the lower end faces of said anode or anodes.

* * * * *

UNITED STATES PATENT AND TRADEMARK OFFICE

CERTIFICATE OF CORRECTION

PATENT NO. : 4,230,540

DATED : October 28, 1980

INVENTOR(S) : Anthony Mill Archer et al.

It is certified that error appears in the above-identified patent and that said Letters Patent are hereby corrected as shown below:

Col. 1, line 37, "novel" should read --level-- .

Col. 3, line 21, after "production" insert --of aluminium-- ;

line 36, before "anode" insert --by-- ;

line 41, "crust" should read --current-- .

Signed and Sealed this

Ninth Day of November 1982

[SEAL]

*Attest:*

GERALD J. MOSSINGHOFF

*Attesting Officer*

*Commissioner of Patents and Trademarks*